US007334586B2

(12) United States Patent
Pilmanis

(10) Patent No.: US 7,334,586 B2
(45) Date of Patent: Feb. 26, 2008

(54) IMPRINTING DEVICE FOR A COSMETIC PRODUCT AND METHOD OF USING SAME

(76) Inventor: Paula Pilmanis, 27838 Pontevedra Dr., Rancho Palos Verde, CA (US) 90732

( * ) Notice: Subject to any disclaimer, the term of this patent is extended or adjusted under 35 U.S.C. 154(b) by 175 days.

(21) Appl. No.: 11/035,503

(22) Filed: Jan. 13, 2005

(65) Prior Publication Data

US 2006/0150994 A1 Jul. 13, 2006

(51) Int. Cl.
*A45D 40/26* (2006.01)

(52) U.S. Cl. ..... 132/320; 132/216

(58) Field of Classification Search ..... 132/215, 132/216, 319, 320, 218; 101/327, 333
See application file for complete search history.

(56) References Cited

U.S. PATENT DOCUMENTS

| | | | | | |
|---|---|---|---|---|---|
| 2,917,058 | A | * | 12/1959 | Ferrar | 132/216 |
| 2,998,821 | A | * | 9/1961 | Hurdel | 132/218 |
| 3,485,251 | A | * | 12/1969 | Brunet | 132/216 |
| 3,660,185 | A | * | 5/1972 | Bonham | 156/72 |
| 3,823,723 | A | * | 7/1974 | Miller | 132/201 |
| 3,898,357 | A | | 8/1975 | Miller et al. | 428/42 |
| 4,024,879 | A | * | 5/1977 | Stryker | 132/216 |
| 4,522,864 | A | | 6/1985 | Humason et al. | 428/201 |
| 4,858,631 | A | * | 8/1989 | Chuang | 132/218 |
| 4,936,325 | A | * | 6/1990 | Davis | 132/319 |
| 5,421,765 | A | | 6/1995 | Lehmann et al. | 446/296 |
| 5,578,353 | A | | 11/1996 | Drew | 428/43 |
| 5,601,859 | A | | 2/1997 | Penaluna | 426/5 |
| 5,810,862 | A | | 9/1998 | Pilmanis | 606/186 |
| 5,860,433 | A | * | 1/1999 | Halpern | 132/319 |
| 5,937,873 | A | | 8/1999 | Schlosser et al. | 132/320 |
| 6,146,721 | A | | 11/2000 | Freynet | 428/7 |
| 6,161,554 | A | * | 12/2000 | Dunlap-Harris | 132/216 |
| 6,264,786 | B1 | | 7/2001 | Cromett | 156/289 |
| 6,290,798 | B1 | | 9/2001 | Onishi et al. | 156/230 |
| 6,508,255 | B1 | | 1/2003 | Glover et al. | 132/216 |
| 6,530,379 | B2 | * | 3/2003 | Iosilevich | 132/319 |
| 6,558,221 | B1 | | 5/2003 | Yang | 446/100 |
| 2003/0015110 | A1 | * | 1/2003 | Lookholder et al. | 101/327 |
| 2004/0134506 | A1 | * | 7/2004 | Nojiri | 132/216 |

* cited by examiner

*Primary Examiner*—Robyn Doan
*Assistant Examiner*—Rachel A. Running
(74) *Attorney, Agent, or Firm*—Daniel J. Meaney, Jr.

(57) ABSTRACT

An imprinting device for a cosmetic product is shown. The imprinting device comprises a transparent substrate and an application element which is fixedly or removeably affixed to and protrudes outwardly from one surface of the transparent substrate. The application element has an exterior surface defining an imprinting member configured to have a cosmetic product coated thereon to be imaged with a surface. A sufficient distance between the one surface and the imprinting member to inhibit a cosmetic product from contacting the one surface when a cosmetic product is coated onto the imprinting member. The application element may be removeably attached to the transparent substrate such that a portion of the application element can be repositioned on the transparent substrate to vary the characteristics of the imprinting member image.

30 Claims, 7 Drawing Sheets

IMPRINTING DEVICE FOR A COSMETIC PRODUCT AND METHOD OF USING SAME

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX" (SEE 37 CFR 1.96)

Not Applicable

BACKGROUND OF THE INVENTION

1. Field of the Invention

The present invention relates to an imprinting device for a cosmetic product and more particularly to an imprinting device for using a cosmetic product coated thereon for imaging an eyebrow or other graphic image onto a selected area of the body of a user. The imprinting device comprises a substantially transparent or transparent substrate and an application element having the imprinting member defining a graphic image which, when coated with a cosmetic product, is then imprinted onto the selected area of the body of a user wherein the user observes the imprinting through a mirror. In the preferred embodiment the application element is removeably attached to transparent substrate and a portion of the removeably attached application element can be repositioned on the transparent substrate to vary the imagining characteristics of the imprinting member.

2. Description of the Prior Art

It is known in the art cosmetically enhance the appearance of an eyebrow or to replace a missing eyebrow by use of a cosmetic marking pencil, brush or substantially equivalent marking instrument. The marking instrument applies a cosmetic material to the appropriate area of the skin above the eye of a user.

It is also known in the art to use a cosmetic marking pencil to form an eyeliner on the eyelid of a user or a line under the eye of a user.

It is also known in the art to use a cosmetic marking pencil to enhance the appearance of a mustache of a user.

It is also known in the art to use a cosmetic marking pencil to provide an artificial beauty mark on the skin, e.g. cheek, of a user.

U.S. Pat. No. 5,810,862 discloses an instrument for the intradermal injection of liquid pigments which is used in procedures for eyebrow replacement or enhancement and/or corneal tattooing. In addition, such an instrument has been used by dermatologists for pigmentation at graft edges, for pigmentation in connection with hair transplants, as well as for pigmentation in connection with surgical reconstruction following mastectomy. The instrument disclosed in U.S. Pat. No. 5,810,862 includes a needle assembly consisting of a number of needles which are supported in a predetermined relationship with one another and with the free ends of the needles extending from solidified glue at the opposite end. The instrument further includes an elongated tubular barrel member and a tubular grip member.

U.S. Pat. No. 6,508,255 discloses an eyeliner applicator which comprises two arms, each arm having a proximal end and a distal end. An applicator surface extends from the distal end of one arm to the distal end of the other arm. The proximal end of the arms may be connected directly to each other or to an intermediary member. Optionally, a stabilizing member may be provided for bracing the applicator against the body of a user during application. Use of the eyeliner applicator comprises contacting the applicator surface with a cosmetic product, placing the applicator service on the eyelid with pressure sufficient to conform the applicator to the couture of the eyelid and lifting the applicator from the eyelid. Typically, a user would use a mirror to visually place the applicator in an appropriate position on the eyelid to form an eye line above the eyelashes on the eyelid of an eye.

U.S. Pat. No. 5,937,873 discloses a device for applying a cosmetic product in the form of a powdery, gel-like or liquid cosmetic product to skin or hair. The device includes at least one application element to hold the cosmetic product and to release the cosmetic product onto the skin or hair upon touching of the skin or hair. The device comprises an application device having a top surface, bottom surface and an edge surface therebetween. At least one elongated application element extends along the edge surface between the top surface and the bottom surface forming an at least partially convex circumferential surface for application of the cosmetic product. The application device includes a reservoir which is filled with a cosmetic product. The application element comprises embellishment motives, i.e. negatives of symbols or similar graphic elements, to be applied to the skin or hair by means of the application device.

U.S. Pat. No. 6,290,798 discloses a method for forming a printed product through a transfer layer bearing an image which is transferred on a transfer-receiving material via a transferring adhesive layer.

U.S. Pat. No. 6,558,221 discloses a stencil mask which is configured to be positioned upon the face surface of a doll and defines a faceplate which generally conforms to the face surface. The faceplate defines a plurality of shaped apertures at locations which correspond to the locations of facial features to be applied to the face of a doll. A plurality of feature stamps, each having shaped flanges corresponding to the aperture shapes of the face plate apertures, support feature image stamps which may be past through the apertures to print upon the face surface of a doll.

U.S. Pat. No. 6,146,721 discloses a device for presenting alternative facial expressions which can be positioned relative to each other to form one of a number of possible facial expressions including an "eyebrow" region and an "eye" region and a "mouth" region. The stamping device is then coated with a medium which is then used to form a display comprising the stamped images, such as, for example, a tabletop display, Halloween decoration or theatrical workshop tool.

Transferable tattoos for transferring an image to the skin of a user or to a printing surface are disclosed in U.S. Pat. Nos. 6,264,786; 5,601,859; 5,578,353 and 5,421,765.

U.S. Pat. No. 4,552,864 discloses a decal which is a combination of a multi-color offset printed design on an extremely thin, flexible, extensible film of water resistant material covering a water soluble slip layer carried by a porous decal paper and uniform deposit of pressure sensitive adhesive covering the design and adapted to hold the design against the skin and protect the design from disruption during application to a skin surface.

U.S. Pat. No. 3,898,357 discloses a method and apparatus for decorating the nails of hands and feet in the form of a decal assembly. The nail is coated with a nail lacquer prior to receiving the decal and then the transferred decal and the nail are coated with a clear transparent nail lacquer.

None of the prior art anticipate, disclose, suggest or teach an imprinting device for a cosmetic product disclosed and taught herein.

BRIEF SUMMARY OF THE INVENTION

The present invention provides a new, novel and unique imprinting device for a cosmetic product. The imprinting device, in the preferred embodiment, is configured to imprint an eyebrow on the skin of a user located above a selected eye. The imprinting device for a cosmetic product comprises a transparent substrate having a pair of opposed spaced surfaces and an application element located on and protruding outwardly from one of the pair of opposed spaced surfaces. The application element has an exterior surface defining an imprinting member configured to have a cosmetic product coated thereon. The application element has a selective thickness or a sufficient distance between the one of the pair of opposed spaced surfaces and the imprinting member to inhibit a cosmetic product from contacting the one of the pair of opposed spaced surfaces when a cosmetic product is coated onto the imprinting member.

In the preferred embodiment, the attachment element is fixedly attached to one surface of a transparent substrate. In another embodiment, the imprinting device attachment element is removablely attached to one surface of a transparent substrate and a portion of the attachment member is removeably attached to one surface of the transparent substrate such that the application element can be repositioned on the one of the pair of opposed spaced surfaces to vary the imaging characteristics of the imprinting member.

In the preferred embodiment, the attachment element defines an outer or exterior surface that defines an imprinting member. The imprinting member is in the shape of an eyebrow to be imprinted upon the skin of a user above a selected eye. A cosmetic product, e.g., a pigment or ink is coated onto the imprinting member. The cosmetic product coated imprinting member is then used to image the skin of a user by means of the cosmetic product being absorbed by the epidermic skin layer. A user can select a pigment or ink of a desired color, e.g., brown, such that the imprinted eyebrow has a desired cosmetic appearance.

The duration or length of time that the imprinted image will stay visibly on the skin is determined by the characteristics of the cosmetic product, the absorption characteristics of the epidermic skin layer and the frequency of which the user washes or uses cleansing materials to remove the imprinted image.

Typically, an imprinted image using known semi-permanent inks as cosmetic products has a duration of about seven (7) days to about ten (10) days. However, it is possible for the user to use a light pigment, e.g., light brown, and then to imprint a second image over the light brown image using a darker pigment, e.g., dark brown, in order to obtain a desired cosmetic appearance.

None of the known prior art devices anticipate, disclose, suggest or teach an imprinting device having a transparent or substantially transparent substrate to enable a user to visually observe the application of the imprinted image onto the skin of a user during the application process. The result is that the user can visually confirm or verify that the imprinted image is being applied at a desired location on the skin of a user.

Therefore, it is an advantage of the present invention to provide an imprinting device for a cosmetic product having a transparent substrate or a substantially substrate through which a user can visually confirm or verify that an imprinted image is being applied to or imaged on to a selected area of the skin of a user.

Another advantage of the present invention is that the imprinting device of the present invention has an attachment element which can be fixedly attached or removeably attached to a surface of a substrate and the attachment element has an exterior surface defining an imprinting member having a predetermined image which is configured to be printed onto a surface, such as for example, a selective area on the skin of a person.

Another advantage of the present invention is that the imprinting device may include an attachment element which is removeably attached to a surface of the substrate such that the removeably attached application element can be repositioned to vary the imaging characteristics of the imprinting member.

Another advantage of the present invention is that the imprinting device may include an attachment element having an imprinting member having a predetermined curvilinear image formed thereon.

Another advantage of the present invention is that the imprinting device may include an attachment element having an imprinting member having a predetermined image formed thereon in the shape of an eyebrow.

Another advantage of the present invention is that the imprinting device may include an attachment element having an imprinting member having a predetermined image comprising a random pattern of dots formed thereon defining an eyebrow.

Another advantage of the present invention is that the imprinting device may include an attachment element having an imprinting member having a predetermined image comprising a random pattern of predetermined shaped areas formed thereon defining an eyebrow.

Another advantage of the present invention is that the imprinting device may include an attachment element having an imprinting member having a predetermined image comprising a random pattern of dots wherein the spacing between edges of the dots is of a dimension to enable a coated cosmetic product to abridge the spacing between dots.

Another advantage of the present invention is that the imprinting device may include an attachment element having an imprinting member having a predetermined image formed thereon in the shape of a curvilinear eyebrow.

Another advantage of the present invention is that the imprinting device may include an attachment element having an imprinting member having a predetermined image formed thereon in the shape of a curvilinear eyebrow having a plurality of spaced curvilinear lines.

Another advantage of the present invention is that the imprinting device may include an attachment element having an imprinting member having a predetermined image formed thereon in the shape of an eyebrow having a plurality of spaced vertically extending ridge members defining individual eyebrow hairs.

Another advantage of the present invention is that the imprinting device may include an attachment element having an imprinting member having a predetermined image formed thereon in the shape of an eyebrow having a plurality of spaced vertically extending ridge members defining individual eyebrow hairs originating from a common base line near an eye and terminating in random ends away from the eye.

Another advantage of the present invention is that the imprinting device may include an attachment element having an imprinting member having a predetermined image formed thereon in the shape of a moustache.

Another advantage of the present invention is that the imprinting device may include an attachment element having an imprinting member having a predetermined image formed thereon in the shape of a sideburn.

Another advantage of the present invention is that the imprinting device may include an attachment element having an imprinting member having a predetermined image formed thereon in the shape of a lip.

Another advantage of the present invention is that the imprinting device may include an attachment element having an imprinting member having a predetermined image formed thereon in the shape of an areola.

Another advantage of the present invention is that a method for imprinting a cosmetic product on a surface is disclosed and taught herein.

Another advantage of the present invention is that a method for imprinting a cosmetic product comprises forming an imprinting device that includes an attachment member having an imprinting member which defines a predetermined image in the form of an eyebrow and the so formed imprinting device is coated with a cosmetic product and a user performs a step of visually observing the cosmetic coated imprinting member through a transparent substrate and concurrently positioned the cosmetic coated and imprinting member at a desired location on a surface in the form of the skin of a user located above a selected eye and rolling the cosmetic coated imprinting member over a desired location on a surface in the form which is the skin of a user to imprint thereon the image on the imprinting member and withdrawing the imprinting member from the imaged surface in the form of the skin of a user.

BRIEF DESCRIPTION OF THE DRAWING

The present invention will become more fully understood from the following detailed description of a preferred but non-limiting embodiment thereof, described in connection with the accompanying drawings, wherein.

DETAILED DESCRIPTION OF THE INVENTION

Background

Figure 1:
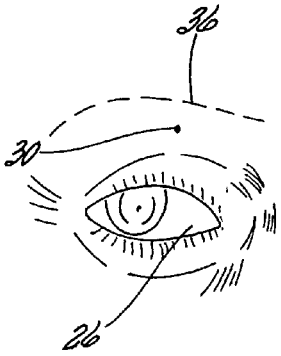
FIG. 1 is a pictorial representation of a partial front elevational view of the face of a user having a pair of eyes comprising a left eye and a right eye wherein the skin of a user above each eye, which is to receive an imprinted eyebrow, is shown by a dashed line.

A specialized need has developed in the field of cosmetology with respect to enhancing areas of or portions of a body of a person using cosmetics and/or cosmetics devices to compensate for deficiencies which can be observed by other persons or for personal reasons. The procedures for cosmetic enhancement may be done professionally or by the person/user, depending on the severity of the deficiency.

One example of such a developing need is in the field of treating cancer using chemotherapy where one of the significant side effects thereof is the loss of hair including loss of hair forming or defining an eyebrow. Also, loss of hair forming or defining an eyebrow can occur as a result of other medical or physical reasons, or conditions.

In such event, a person who experiences such a loss may desire to have the eyebrow enhanced or to have a replacement eyebrow imaged on the user's skin above the eye.

The teachings of the present invention provide such a person with the ability to enhance the eyebrow or to have a replacement eyebrow imaged on the user's skin above the eye using a novel and unique imprinting device and method disclosed herein.

In treatment of breast cancer, a partial or complete mastectomy may be performed followed by a mammoplasty to reconstruct the size and shape of the breast. In performing a breast reconstruction, the areola, out of which the nipple protrudes, may be removed. The areola may include a darken area. For cosmetic and other reasons, a person who experiences such a loss, may desires to have an areola image which may include an image of a nipple imprinted on the skin of a reconstructed breast at a location where the areola area is typically physically located.

The teachings of the present invention provide such a person with the ability to have a areola image imprinted in an areola area, e.g. where the areola area is typically physically located, of the skin of a reconstructed breast by using a novel and unique imprinting device and method disclosed herein.

Other cosmetic applications may include imaging lips, sideburns, moustaches or the like on an appropriate skin area of a person using the teachings of the present invention by using a novel and unique imprinting device and method disclosed herein.

One important factor which effects the efficacy of using the novel and unique imprinting device disclosed herein is the condition of the epidermis that is the outer layer of the skin. The epidermis is the thinnest layer and provides protection of the body from a harsh environment. The epidermis is made up of five (5) layers, namely: (i) the stratum germinativum; (ii) stratum spinosum; (iii) the stratum granulosum; (iv) the stratum lucidum and (v) the stratum corneum.

In using the imprinting device of the present invention, the selection of the a cosmetic product that is coated onto the imprinting member of the imprinting device may be determined or influenced by the dryness or other characteristics of the epidermis including the layers thereof as described above. In addition, the longevity of the imprinted image on the skin is a function of the characteristics and physical condition of the epidermis including the layers thereof. Typically, the cosmetic product, e.g., ink is absorbed by first the layers, namely, the stratum germinativum and the stratum spinosum.

It is envisioned that the cosmetic product used for practicing the invention would be selected to maximize the benefit of, e.g., color for example, and/or the longevity of the image imprinted onto an appropriate skin area of a user.

In describing the invention below with respect to the various figures, common elements illustrated in each of the figures are identified with the same numerals.

Imprinting Device and Method of Using Same

In the pictorial representation of a partial front elevational view of FIG. 1, the face shown by arrow 22 of a user shown generally by arrow 20 has a pair of eyes comprising a left eye 26 and a right eye 28. The skin of a user above each eye 26 and 28 which is shown generally as 30 and 32, respectively, is to receive an imprinted eyebrow image and the desired location for the imprinted image is shown by dashed lines 36 and 38, respectively.

Figure 2:
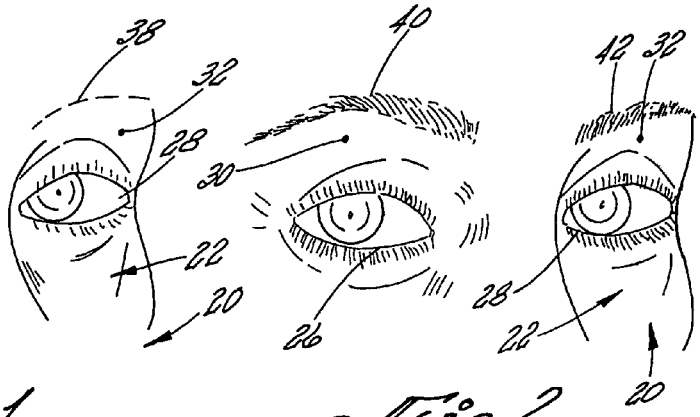
FIG. 2 is a pictorial representation of a partial front elevational view as shown in FIG. 1 showing that the skin of a user above each eye has been imprinted with an eyebrow image.
Figure 3A:
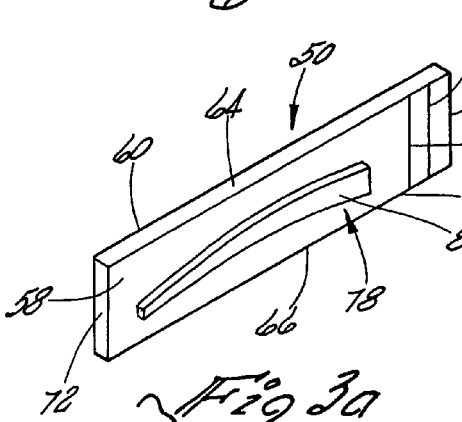
FIG. 3*a* is a front, top and left side perspective view of an imprinting device for a cosmetic product comprising a transparent substrate having a pair of opposed spaced surfaces hereto and an application element defining an imprinting member attached thereto wherein the imprinting member is in the form of an eyebrow to be imaged on the skin of a user above the left eye.
Figure 3B:
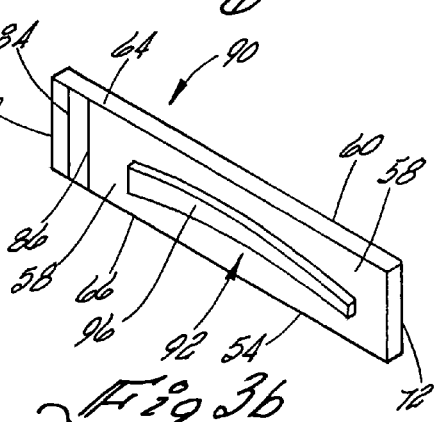
FIG. 3*b* is a front, top and right side perspective view of an imprinting device for a cosmetic product comprising a transparent substrate having a pair of opposed spaced surfaces hereto and an application element defining an imprinting member attached thereto wherein the imprinting member is in the form of an eyebrow to be imaged on the skin of a user above the right eye.

In the pictorial representation of a FIG. 2, which is of the same partial front elevational view as shown in FIG. 1, the skin of a user above each eye 26 and 28 has been imprinted with an eyebrow image using the imprinting devices 50 and 90, as shown in FIGS. 3*a* and 3*b*, respectively. The imprinted eyebrow images are depicted by left eyebrow 40 and right eyebrow 42 located, above eyes 26 and 28, respectively.

An imprinting device for a cosmetic product 50 is shown in FIGS. 3*a* and 3*b*. In FIG. 3*a*, the imprinting device 50 comprises a substantially transparent or transparent substrate, collectively referred to herein as the substrate 54, has a pair of opposed spaced surfaces 58 and 60. The substrate 54 is sufficiently transparent to permit a user to visually see through the thickness of the substrate 59 and observe the printing surface, e.g. skin of a user, to be imprinted with the image. The thickness of the substrate 54 may be in the order of about ⅛ inch to about ¾ inch with a thickness of about ⅜ inch being preferred.

The substrate 54 is, in the preferred embodiment, generally rectangular in shape and defines a pair of spaced elongated sides 64 and 66 having a first shorter end 70 and an opposed second shorter end 72 extending there between.

An application element shown generally by arrow 78 defines an imprinting member, collectively referred to herein as the imprinting member 80, which is removeably or fixedly attached to the surface 58 of the substrate 54. In FIG. 3*a*, the imprinting member 80 is in the form of an eyebrow to be imaged on the skin 30 of a user 22 above the left eye 26 as shown in FIGS. 1 and 2.

As illustrated in FIG. 3*a*, imprinting member 80 is spaced between the pair of elongated sides 64 and 66 and is located a predetermined distance from the first shorter end 70.

Figure 7:
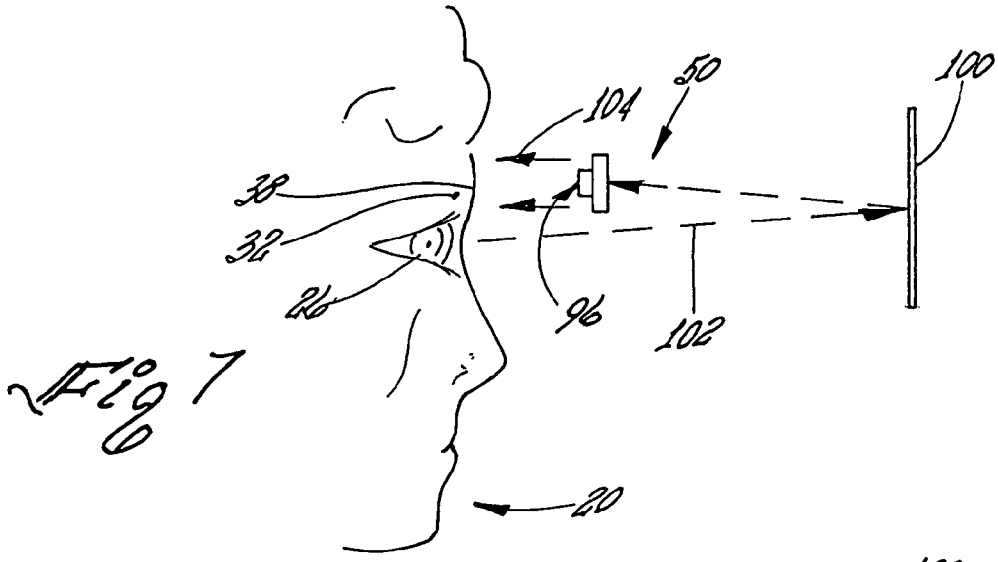
FIG. 7 is a partial pictorial view of the right side of the face of a user showing a right eye wherein the user is visibly observing in a mirror a cosmetic coated imprinting member of an imprinting device through a transparent substrate and concurrently positioning the cosmetic coated imprinting member at a desired location on a surface in the form of the skin of a user to be imaged.
Figure 8:
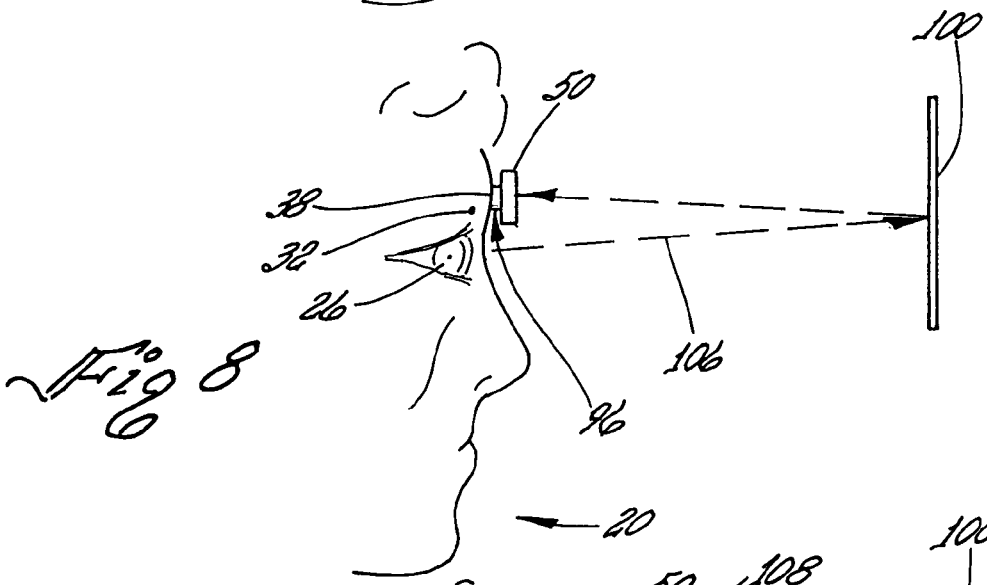
FIG. 8 is a partial pictorial view of the right side of the face of a user showing a right eye wherein the user is observing in a mirror the rolling of the cosmetic coated imprinting member over the desired location on the surface in the form of the skin of a user to imprint thereon the image in the shape of an eyebrow formed on the imprinting member.
Figure 9:
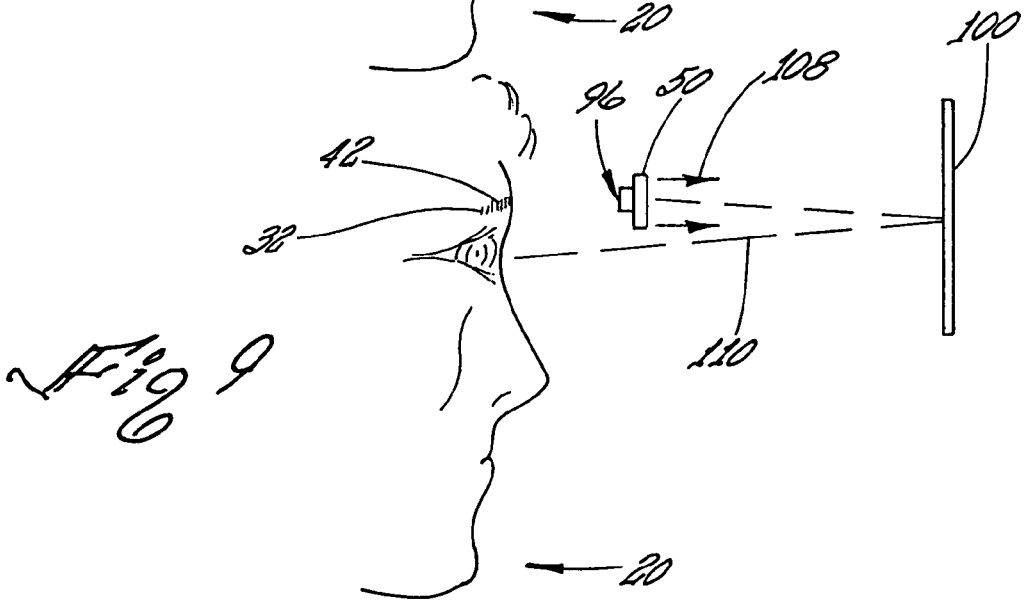
FIG. 9 is a partial pictorial view of the right side of the face of a user showing a right eye wherein the user observing in a mirror is the withdrawing the imprinting member from the surface.

The first shorter end 70 has at least one guideline 84 formed thereon which extends substantially perpendicular between the pair of spaced elongated sides 64 and 66 and substantially parallel to the first shorter end 70 and the second shorter end 72. The at least one guideline 84 is positioned at a predetermined location between the first shorter end 70 and the imprinting member 80. The at least one guideline 84 is configured to enable a user 20 to visually position, while observing through a mirror, the at least one guideline 84 in substantial alignment with a user's nose while concurrently observing through the transparent substrate 54 that a cosmetic material coated imprinting member 80 is correctly positioned over the eye thereby enabling a user 22 to bring the imprinting member 80 into contact with and to imprint an eyebrow on a printing surface in the form of skin 30 above an eye 26 of a user 22. This is shown in FIGS. 7, 8 and 9 as discussed below.

In the preferred embodiment as shown in FIG. 3*a*, the first shorter end 70 has at least two spaced guidelines 84 and 86 formed thereon which extend substantially perpendicular between the pair of spaced elongated sides 64 and 66 and which are substantially parallel to the first shorter end 70 and the second shorter end 72. The at least two guidelines 84 and 86 are positioned at a predetermined location between the first shorter end 70 and the imprinting member 80. The at least two guidelines 84 and 86 are configured to enable a user 20 to visually position which observing through a mirror one of the two guidelines 84 or 86 in substantial alignment with a user's nose while concurrently observing through said transparent substrate 54 that a cosmetic material coated imprinting member 80 is correctly positioned over the eye 26 thereby enabling a user 20 to bring the imprinting member 80 into contact with and to imprint an eyebrow on to a printing surface in the form of skin 30 above the eye 26 of a user 20. The reason for the at least two guide lines 84 and 86 is that the distance between the nose of a user 20 and the beginning of an eyebrow, which is proximal to the nose of each of the left eye 26 and the right eye 28, may be of different dimensions and the guidelines 84 and 86 enable the user 20 to compensate for such differences in dimension by visually selecting the appropriate guideline 84 or 86 for alignment of the imprinting member 80 to the appropriate location 30 on the skin as described above.

In FIG. 3*b*, the imprinting member 90 for a cosmetic product is in the form of an eyebrow to be imaged on the skin 30 of a user 22 above the right eye 28 as shown in FIGS. 1 and 2. The imprinting device 90 includes a transparent substrate 54 that is identical in stricture to the transparent substrate 54 of FIG. 3*a*. The transparent substrate 54 likewise has a pair of opposed spaced surfaces 64 and 66 having a first shorter end 70 and an opposed second shorter end 72 extending there between.

An application element shown generally by arrow 92 defines an imprinting member or imprinting element, which in this FIG. 3*a* is identified as imprinting member 96 that is in the form of a right eyebrow which imprinting member 96 is removeably or fixedly attached to the surface 58 of the substrate 54. In FIG. 3*b*, the imprinting member 96, in the form of a right eyebrow, is to be imaged on the skin 30 of a user 22 above the left eye 28 as shown in FIGS. 1 and 2.

As illustrated in FIG. 3*b*, imprinting member 96 is spaced between the pair of elongated sides 64 and 66 and is located a predetermined distance from the first shorter end 70.

In FIG. 3*b*, the first shorter end 70 likewise has, in a structure shown in FIG. 3*a*, at least two spaced guidelines 84 and 86 formed thereon which extend substantially perpendicular between the pair of spaced elongated sides 64 and 66 and which are substantially parallel to the first shorter end 70 and the second shorter end 72. The at least two guidelines 84 and 86 are positioned at a predetermined location between the first shorter end 70 and the imprinting member 96. The at least two guidelines 84 and 86 are configured to enable a user 20 to visually position which observing through a mirror one of the two guidelines 84 or 86 in substantial alignment with a user's nose while concurrently observing through said transparent substrate 54 that a cosmetic material coated imprinting member 96 is correctly positioned over the eye 28 thereby enabling a user 20 to bring the imprinting member 96 into contact with and to imprint an eyebrow on to a printing surface in the form of skin 30 above the eye 28 of a user 20. The reason for the at least two guide lines 84 and 86 is that the distance between the nose of a user 20 and the beginning of an eyebrow, which is proximal to the nose of each of the right eye 28 and the left eye 26, may be of different dimensions and the guidelines 84 and 86 enable the user 20 to compensate for such differences in dimension by visually selecting the appropriate guideline 84 or 86 for alignment of the imprinting member 80 to the appropriate location 30 on the skin as described above.

Figure 4:
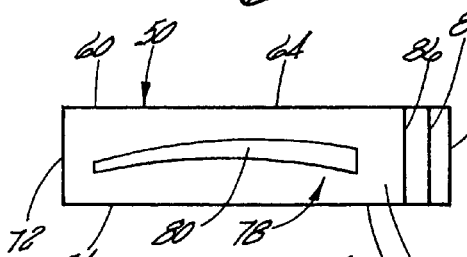
FIG. 4 is a front elevational view of the imprinting device of FIG. 3*a;*

In FIG. 4, the front elevational view of the imprinting device for a cosmetic product 50, shows in detail the structural relationship of the substantially transparent or transparent substrate 54 and the other surface 58 of the pair of opposed spaced surfaces 58 and 60 shown in FIG. 3*a*. The substrate 54 is generally rectangular in shape and is defined by the pair of spaced elongated sides 64 and 66 having a first shorter end 70 and an opposed second shorter end 72 extending there between.

The application element shown generally by arrow 78 is in the form of an eyebrow to be imaged on the skin 30 of a user 20 above the left eye 26 as shown in FIGS. 1 and 2. The imprinting member 80 is spaced between the pair of elongated sides 64 and 66 and is located a predetermined distance from the first shorter end 70. The first shorter end 70 has the at least two spaced guidelines 84 and 86 formed thereon which extend substantially perpendicular between the pair of spaced elongated sides 64 and 66 and which are substantially parallel to the first shorter end 70 and the second shorter end 72.

Figure 5:
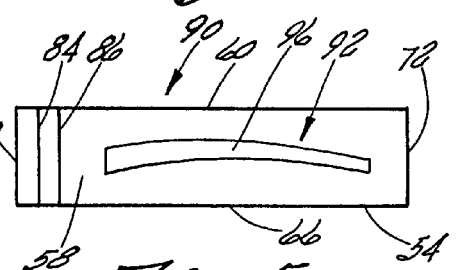
FIG. 5 is a front elevational view of the imprinting device of FIG. 3*b;*

FIG. 5, the front elevational view of the imprinting device for a cosmetic product 90 of FIG. 3*b*, shows in detail the structural relationship of the substantially transparent or transparent substrate 54 and the other surface 58 of the pair of opposed spaced surfaces 58 and 60. The substrate 54 is generally rectangular in shape and is defined by the pair of spaced elongated sides 64 and 66 having a first shorter end 70 and an opposed second shorter end 72 extending there between.

The application element shown generally by arrow 92 is in the form of an eyebrow to be imaged on the skin 30 of a user 20 above the right eye 26 as shown in FIGS. 1 and 2. The imprinting member 96 is spaced between the pair of elongated sides 64 and 66 and is located a predetermined distance from the first shorter end 70. The first shorter end 70 has the at least two spaced guidelines 84 and 86 formed thereon which extend substantially perpendicular between the pair of spaced elongated sides 64 and 66 and which are substantially parallel to the first shorter end 70 and the second shorter end 72.

Figure 6:
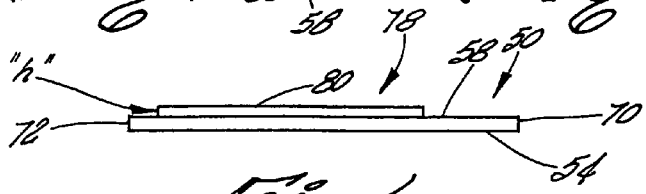
FIG. 6 is a top plan view of the imprinting device of FIG. 4.

As is shown in the top plan view of FIG. 6 and in the front elevational views of FIG. 3*a* and FIG. 3*b*, the device for applying a cosmetic product 50 includes a transparent substrate 54 having a first surface 54 and an opposed spaced substantially parallel second surface 58 and an outer circumferential edge having a thickness defined by the spacing between the first surface 54 and the second surface 58. The application element 78 is located on one of the first surface 54 and the second surface 58, and in this embodiment the application element 78 is located on the second surface 58. The application element has an exterior surface positioned in an opposed spaced relationship from the second surface 58, which is one of the first surface 54 and the second surface 58. The exterior surface of the application element 78 defines an imprinting member 80 which is configured to have a cosmetic product coated thereon. The application element 78 has a height between the imprinting member 96 and the second surface 54, shown by arrow "h", which is of a dimension to inhibit a cosmetic product from contacting the second surface 58 when a cosmetic product is being coated on the imprinting member.

The height "h" of the application member 78 may be in the order of about 1/16 inch to about 1/2 inch with a thickness of about 1/8 inch being preferred.

The present invention also discloses and teaches a method for imprinting a cosmetic product on a surface.

In the preferred embodiment, the imprinting member or imprinting element is in the form of an eyebrow and the surface is in the form of the skin of a user located above a selected eyebrow.

The method comprises the steps of: (i) forming an imprinting device having a transparent substrate having a pair of opposed spaced surfaces and an application element located on and protruding outwardly from one of the pair of opposed spaced surfaces and wherein the application element has an exterior surface defining an imprinting member having a selected image and configured to have a cosmetic product coated thereon and further wherein the application element has a sufficient distance between the one of the pair of opposed spaced surfaces and said imprinting member to inhibit a cosmetic product from contacting said one of the pair of opposed spaced surfaces when a cosmetic product is coated onto said imprinting member; (ii) applying a cosmetic product onto the imprinting member; (iii) visibly observing the cosmetic coated imprinting member through the transparent substrate and concurrently positioning the cosmetic coated imprinting member at a desired location on a surface to be imaged; (iv) rolling the cosmetic coated imprinting member over the desired location on the surface to imprint thereon the image on said imprinting member; and (v) withdrawing the imprinting member from the surface.

FIG. 7 pictorially illustrates the right side of the face 22 of a user 20 showing a right eye 26 of the user 20 and illustrates the step of the user visibly observing in a mirror 100, along a visual path depicted by dashed lines 102, a cosmetic coated imprinting member 96 of an imprinting device 50 through a transparent substrate 54 and concurrently positioning, as depicted by arrows 104, the cosmetic coated imprinting member 96 at a desired location on a surface in the form of the skin 32 above eye 26 of a user 20 to be imaged.

FIG. 8 pictorially illustrates the right side of the face 22 of a user 20 showing a right eye 26 and illustrates the step of the user observing in a mirror 100, along a visual path depicted by dashed lines 106, the rolling of the cosmetic coated imprinting member 96 over the desired location on the surface in the form of the skin 32 of a user 20 to imprint thereon the image in the shape of an eyebrow 42 formed on the imprinting member 96.

FIG. 9 pictorially illustrates the right side of the face 22 of a user 20 having a right eye 26 and illustrates the step of the user observing in a mirror 100, along a visual path depicted by dashed lines 110, the withdrawing the imprinting member 96, as depicted by arrows 108, from the surface, e.g. skin 32, of a user.

Figure 10:
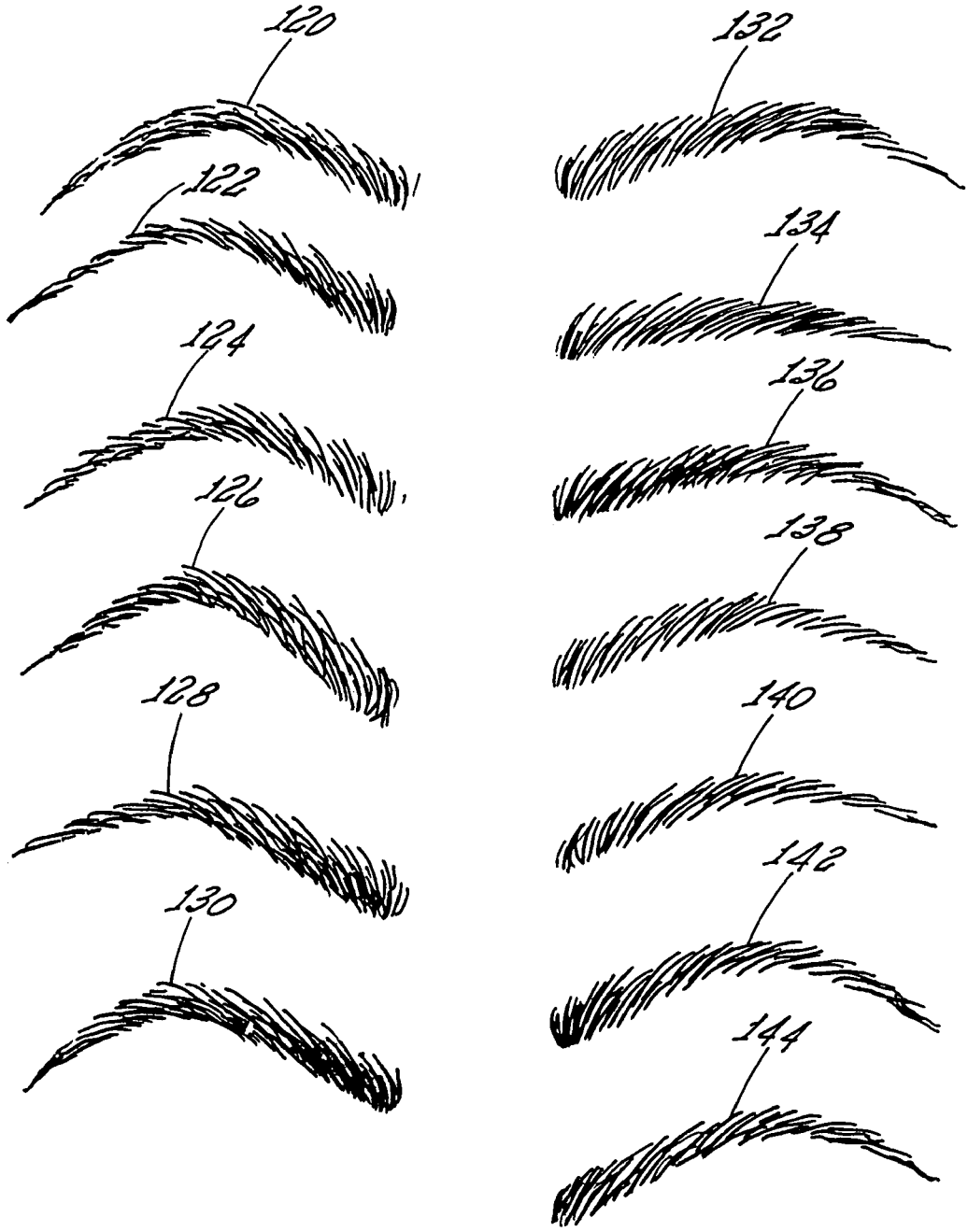
FIG. 10 is a pictorial representation of a plurality of eyebrow shapes for eyebrows for use with one of the right eye or the left eye configured for use as a predetermined image to be formed on the imprinting member wherein the shape of an eyebrow has a plurality of spaced vertically extending ridge members defining individual eyebrow hairs.

FIG. 10 illustrates, in pictorial representations, a plurality of eyebrow shapes for eyebrows wherein the imprinting member has a predetermined image formed thereon in the shape of an eyebrow having a plurality of spaced vertically extending ridge members defining individual eyebrow hairs. The eyebrow shapes identified as 120, 122, 124, 126, 128 and 130 are configured for use above the left eye. The eyebrow shapes identified as 132, 134, 136, 138, 140, 142 and 144 are configured for use above the right eye.

Figure 11:
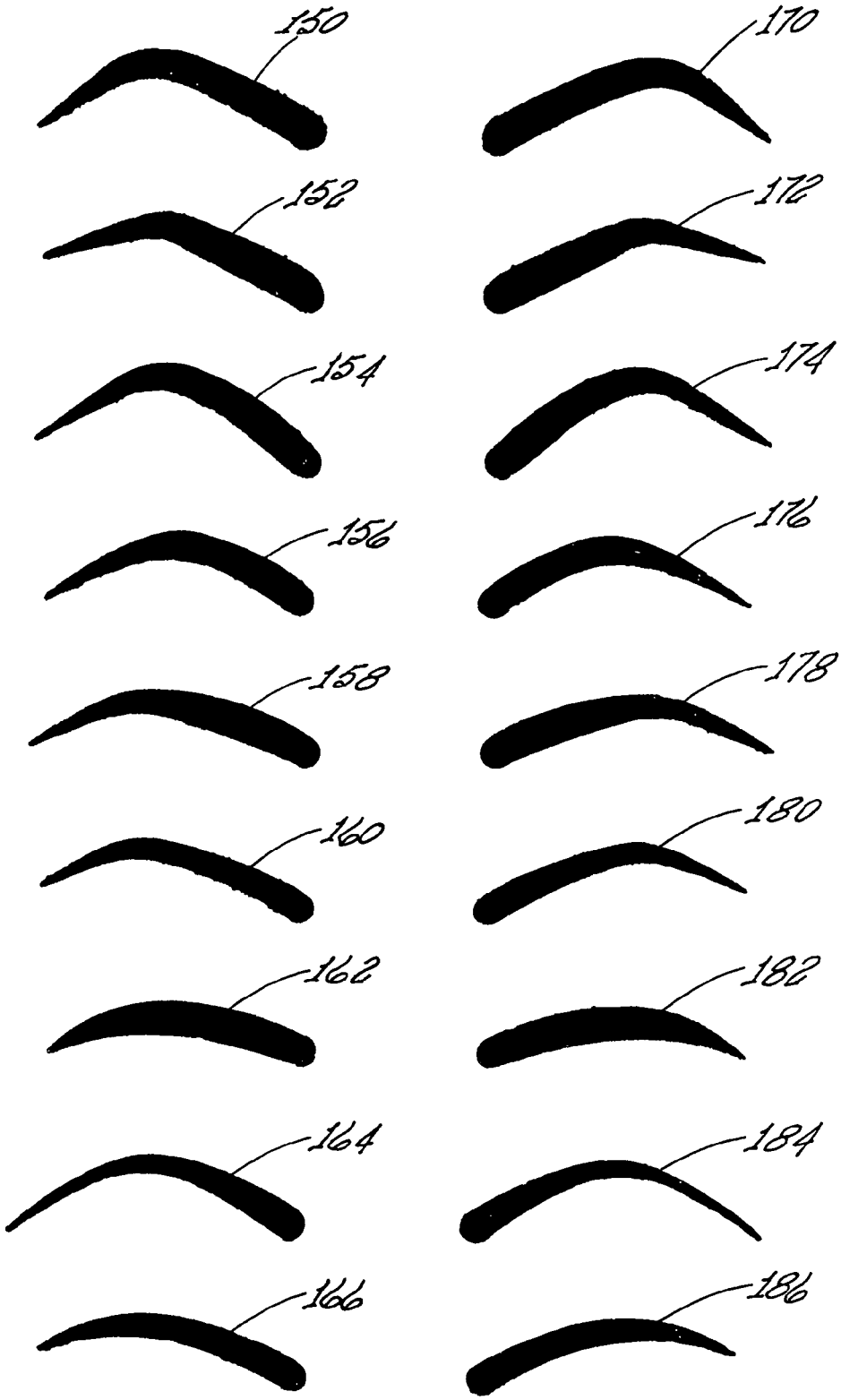
FIG. 11 is a pictorial representation of a plurality of eyebrow shapes for eyebrows for use with one of the right eye or the left eye configured for use as a predetermined image to be formed on the imprinting member wherein the shape of an eyebrow is of a curvilinear eyebrow.

FIG. 11 illustrates, in pictorial representations, a plurality of eyebrow shapes for eyebrows wherein the imprinting member has a predetermined image formed thereon in the shape of wherein the shape of an eyebrow is of a curvilinear eyebrow. The eyebrow shapes identified as 150, 152, 154, 156, 158, 160, 162, 164 and 166 are configured for use above the left eye. The eyebrow shapes identified as 170, 172, 174, 176, 178, 180, 182, 184 and 186 are configured for use above the right eye.

Figure 12:
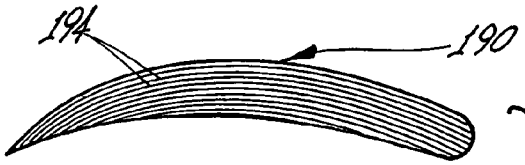
FIG. 12 is a pictorial representations of an eyebrow configured for use as an eyebrow above the left eye of a user wherein the eyebrow is in the form of a curvilinear eyebrow having a plurality of spaced curvilinear lines.

FIG. 12 illustrates, in a pictorial representation, an eyebrow 190 configured for use as an eyebrow above the left eye of a user wherein the eyebrow 190 is of a curvilinear eyebrow having a plurality of spaced curvilinear lines 194.

Figure 13:
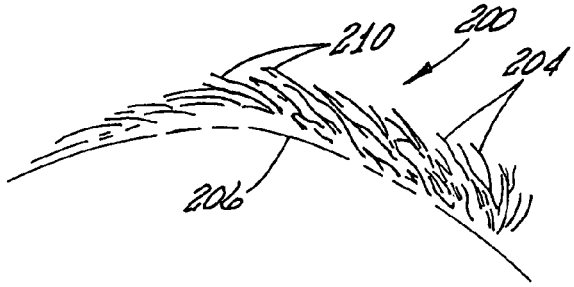
FIG. 13 is a pictorial representations of an eyebrow configured for use as an eyebrow above the left eye of a user wherein the eyebrow is of a plurality of spaced vertically extending ridge members defining individual eyebrow hairs originating from a common base line near an eye and terminating in random ends away from the eye.

FIG. 13 illustrates, in pictorial representation, an eyebrow configured for use as an eyebrow 200 above the left eye of a user wherein the eyebrow 200 is of a plurality of spaced vertically extending ridge members 204 defining individual eyebrow hairs originating from a common base line shown by dashed line 206 near an eye and terminating in random ends 210 away from the eye.

Figure 14:
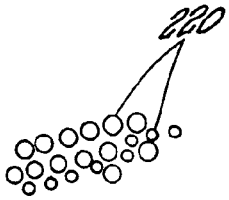
FIG. 14 is a pictorial representation of a portion of the imprinting member of an imprinting device having a predetermined image comprising a random pattern of dots formed thereon defining an eyebrow.

FIG. 14 depicts in a pictorial representation of a portion of the exterior or outer surface of imprinting member of an imprinting device having a predetermined image formed thereon. In the embodiment of FIG. 14, the imprinting member surface is formed of a random pattern of dots shown as 220 formed thereon defining an eyebrow.

Figure 15:
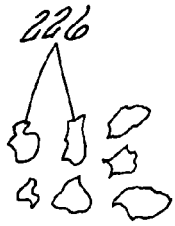
FIG. 15 is a pictorial representation of a portion of the imprinting member of an imprinting device having a predetermined image comprising a random pattern of predetermined shaped areas formed thereon defining an eyebrow.

FIG. 15 depicts in a pictorial representation of a portion of the exterior or outer surface of another embodiment of an imprinting member of an imprinting device having a predetermined image formed thereon. In the embodiment of FIG. 15, the imprinting member surface is formed of a random pattern of predetermined shaped areas 226 formed thereon defining an eyebrow.

Figure 16:
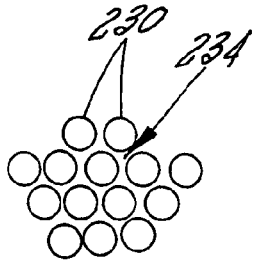
FIG. 16 is a pictorial representation of a portion of the imprinting member of an imprinting device having a predetermined image comprising a random pattern of dots formed thereon defining an eyebrow wherein the spacing between edges of the dots defining the random pattern of dots is of a substantially uniform dimension to enable a coated cosmetic product to bridge the spacing between dots.

FIG. 16 is a pictorial representation of a portion of the exterior surface of imprinting member of an imprinting device having a predetermined image comprising a random pattern of dots 230 having a substantially uniform dimension e.g., substantially same diameter, formed thereon defining an eyebrow wherein the spacing between edges of the dots 230 shown by arrow 234 is of a substantially uniform spacing to enable a coated cosmetic imprinting member to bridge the spacing 234 between dots 230.

As discussed above, the teaching of the present invention has utility for other application including cosmetic application. Discussed below are several examples of use of the imprinting device for a cosmetic product for other applications.

Figure 17:
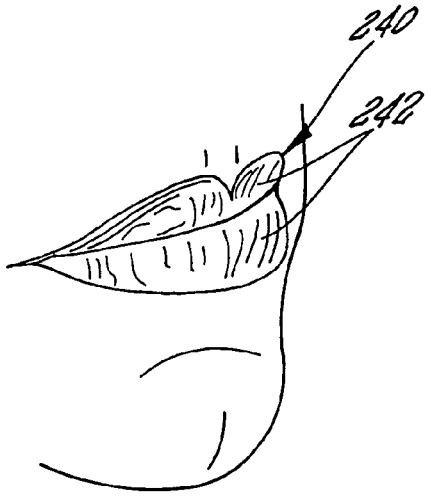
FIG. 17 is a pictorial representation of a partial front elevational view of the mouth of a user having lips wherein the lips of a user is to receive an imprinted lip image.

The pictorial representation of FIG. 17 is a partial front elevational view of the mouth 240 of a user having lips 242 wherein the lips 242 of a user are to receive an imprinted lip image.

Figure 18:
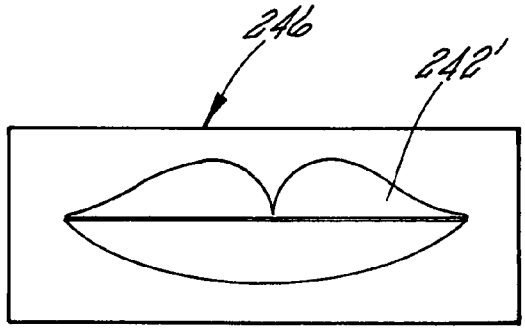
FIG. 18 is a front elevational view of an imprinting device having an imprinting member having a predetermined image formed thereon in the shape of a lip which is to be imaged on the lips shown in FIG. 17.

FIG. 18 is a front elevational view of an imprinting device 246 having an imprinting member having a predetermined image formed thereon in the shape of a lip 242' which is to be imaged on the lips 242 shown in FIG. 17.

Figure 19:
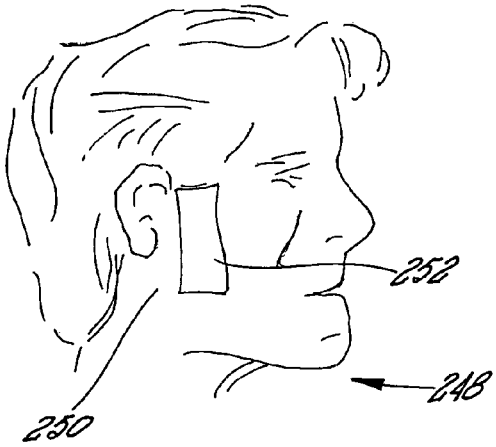
FIG. 19 is a pictorial representation of a partial side elevational view of the head of a user having a sideburn area surface of a user that is to receive a sideburn image.

The pictorial representation of FIG. 19 is a partial side elevational view of the head 248 of a user having a sideburn area surface 250 of a user that is to receive a sideburn image 252.

Figure 20:
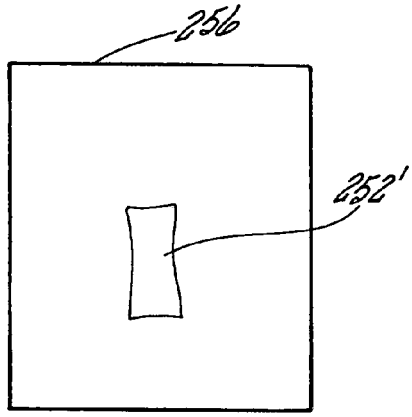
FIG. 20 is a front elevational view of an imprinting device having an imprinting member having a predetermined image formed thereon in the shape of a sideburn to be imaged on the sideburn area surface shown in FIG. 19.

FIG. 20 is a front elevational view of an imprinting device 246 having an imprinting member having a predetermined image formed thereon in the shape of a sideburn 252' to be imaged on the sideburn area surface 250 shown in FIG. 19.

Figure 21:
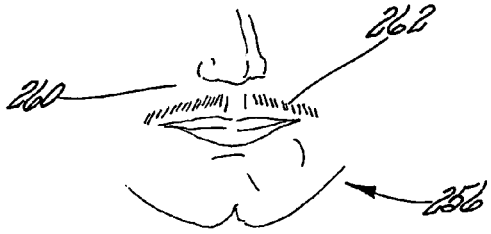
FIG. 21 is a pictorial representation of a partial front elevational view of the nose and mouth area of a user having a moustache area surface of a user that is to receive an moustache image.

The pictorial representation of FIG. 21 is a partial front elevational view of the nose and mouth area 256 of a user having a moustache area surface 260 of a user that is to receive a moustache image 262.

Figure 22:
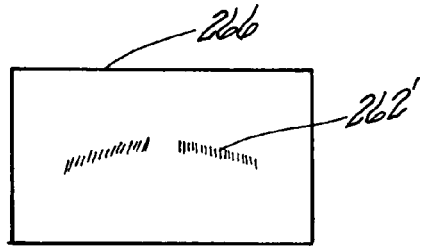
FIG. 22 is a front elevational view of an imprinting device having an imprinting member having a predetermined image formed thereon in the shape of a moustache to be imaged on the moustache area shown in FIG. 21.

FIG. 22 is a front elevational view of an imprinting device 266 having an imprinting member of an having a predetermined image formed thereon in the shape of a moustache 262'to be imaged on the moustache area 262 shown in FIG. 21.

Figure 23:
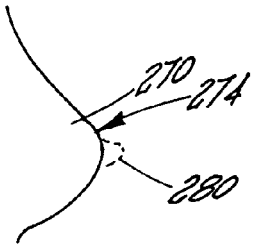
FIG. 23 is a pictorial representation of a partial side elevational view of a breast of a user having an areola area surface having a missing areola including a nipple as shown by a dashed line, which areola area surface is to receive an areola image.
Figure 24:
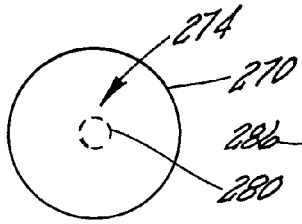
FIG. 24 is a pictorial representation of a partial front plan view of a breast area a user shown in FIG. 23 having an areola area surface of a user with a missing nipple being shown by a dashed line, which areola area surface is to receive an areola image.

FIG. 23 and FIG. 24 are pictorial representations of a partial side elevational view of a breast 270 of a user and a partial front plan view of a breast 270 of a user, respectively. The breast 270 has an areola area surface shown by arrow 274 having a missing areola shown including a nipple as shown by a dashed line 280, which areola area surface 274 is to receive an areola image.

When a partial or complete mastectomy is performed as part of a breast cancer treatment, the mastectomy procedure is usually followed by a mammoplasty wherein a plastic surgeon typically reconstructs the size and shape of the breast. In certain instances, the areola, out of which the nipple protrudes including a simulated darken area, may be surgically reconstructed using body tissue. It is also common for the plastic surgeon to merely leave the tissue in the area comprising the areola area smooth and to refrain from reconstructing an artificial areola. In such instances, the person who experiences such a loss, may desires to have an areola image, which may include an image of a nipple, imprinted on the skin of a reconstructed breast 270 at a location where the areola area 274 including a nipple 280 is typically physically located.

Figure 25:
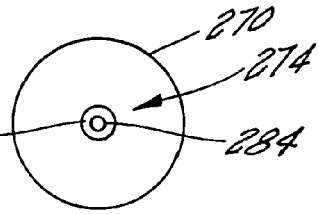
FIG. 25 is a pictorial representation of a partial front plan view of a breast area a user shown in FIG. 24 having an areola area surface of a user, which areola area surface has been imaged with an areola image imprinted by an imprinting device using the teachings of this invention.
Figure 26:
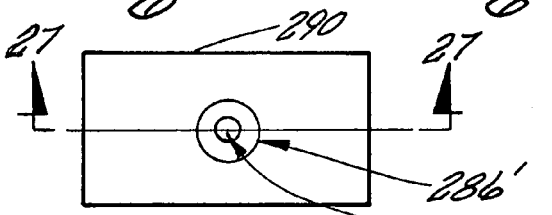
FIG. 26 is a front elevational view of an imprinting device having an imprinting member having a predetermined image formed thereon in the shape of an areola to be imaged on the areola area shown in FIG. 24.
Figure 27:
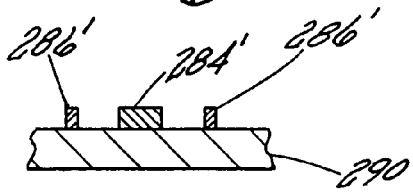
FIG. 27 is a pictorial representation of a partial cross-sectional view of the imprinting device of FIG. 26 taken along section lines 27-27 of FIG. 26.

FIG. 25 is a pictorial representation of a partial front plan view of a breast 270 of a user shown in FIG. 24 having an areola area surface 274 wherein the areola area surface 274 has been imaged with an areola image imprinted by an imprinting device 290 shown in FIGS. 26 and 27 using the teachings of this invention. The areola image includes a nipple image 284 and a small outer ring 286 which simulates an areola darken area.

In FIG. 26, a front elevational view of an imprinting device 290 having an imprinting member having a predetermined image formed thereon in the shape of a simulated areola to be imaged on the areola area 274 as shown in FIG. 24. The attachment element comprises a nipple imprinting member 284' and an areola ring imprinting member 286' which is configured to be imaged on the areola are 274 to form the imprinted areola image as shown in FIG. 25.

The pictorial representation of FIG. 27 shows in a partial cross-sectional view the structural details of the imprinting device 290 of FIG. 26 taken along section lines 27-27 of FIG. 26. The imprinting device 290 includes attachment elements in the form of a nipple imprinting member 284' and an areola ring imprinting member 286'. When the imprinting members 284' and 286' are coated with a cosmetic product, the coated image is applied to the breast 270. The user may perform the imprinting process either under direct visual observation or by indirect observation wherein a user uses a mirror similar to the mirror 100 discussed above in connection with FIGS. 7 through 9. The imaged areola would comprise an imaged nipple and areola ring image as shown in FIG. 25.

As discussed above in connection with FIGS. 1 through 6, the application member 78 or 92 may be fixedly attached to substrate 54. In such event, the user 20 would use the shape as defined by the imprinting member of the attachment member 78 or 92, respectively, in the fixed format for imaging the skin of a user.

In the alternative and to enable the user to vary the shape of the imprinting member, the application element may be removeably attached to a surface of the substrate. By doing so, a portion of the application element can be repositioned to vary the shape of the image.

Figure 28:
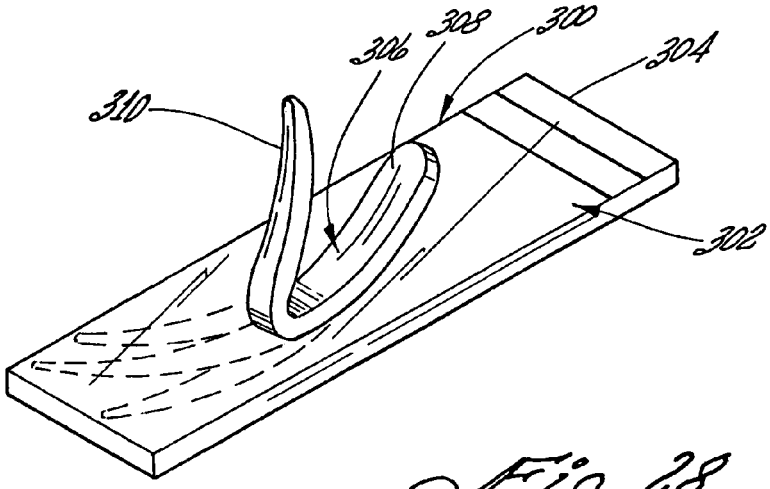
FIG. 28 is a rear, top and left side perspective view of an imprinting device wherein the application element is removeably attached to one of a pair of opposed spaced surfaces and illustrating that a portion of the application element can be repositioned.

The imprinting device 300 depicted in FIG. 28 includes a transparent substrate 304 illustrating that the application element shown by arrow 306 is removeably attached to one of a pair of opposed spaced surfaces, surface 302. The application element 306 has a portion thereof, identified as portion 308, which is attached to the surface 302 and an elevated portion 310 thereof which can be repositioned.

There are two (2) methods or techniques for removeably attaching the application element 306 to the transparent substrate 204.

The first technique is utilized by the imprinting device 300 depicted in FIG. 28. In the preferred embodiment, the transparent substrate 304 is formed of an acrylic. The application element 306 is formed of a photo polymer. A natural adhesion exists between an acrylic and a photo polymer such that the attachment element 306 naturally adheres to and is removeably affixed or removeably attached to one of the pair of opposed surfaces, surface 302. The natural adhesion permit or enables the user to lift a portion of the application element 306, depicted as portion 310, and to repositioned the same at a desired location on a transparent substrate 304 as described above.

Figure 32:
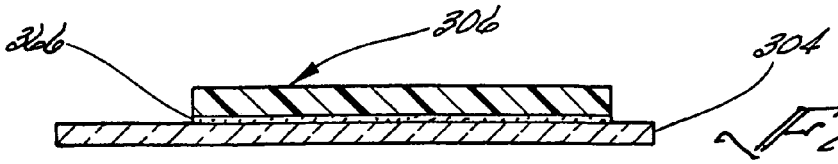
FIG. 32 is a top plan view of the imprinting device shown in FIG. 30.

The second technique utilizes an adhesive layer which is coated between or located between one of a pair of opposed space surfaces and the application element. The second method or technique is depicted by FIG. 32 as discussed below. This is described in greater detail in connection with the discussion of FIG. 32.

Figure 29:
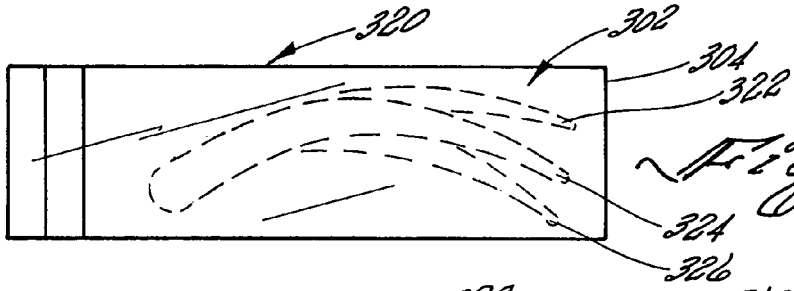
FIG. 29 is a rear elevational view of a transparent substrate of an imprinting device for a cosmetic product illustrating a template for three positions into which the application element having an imprinting member can be repositioned to vary the characteristics of the imprinting member.

FIG. 29 depicts transparent substrate 304 which can be used for the imprinting device 300 depicted in FIG. 28. In FIG. 29, the back or rear side of surface 302 of the transparent substrate 304 is shown without the attachment element 306 being removeably attached thereto. The back or rear surface of the substrate 302 is shown as having formed, printed, etched or otherwise imaged thereon a template illustrating three positions 322, 324 and 326 into which the application element 306 can be repositioned to vary the imagining characteristics of the imprinting member 306. For example, position 322 makes the shape of the eyebrow follow a path which tends to be parallel to the eye, position 324 makes the shape of the eyebrow into a slight curve towards the eye and position 326 provides a more accurate shape of the eyebrow towards the eye.

Figure 30:
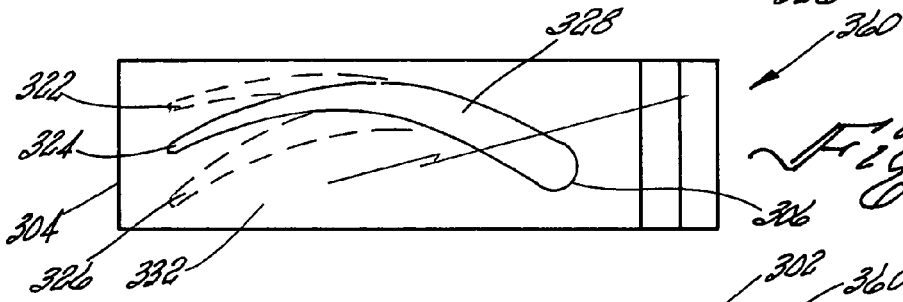
FIG. 30 is a front elevational view of an imprinting device for a cosmetic product comprising a transparent substrate having a pair of opposed spaced surfaces and an application element defining an imprinting member which is removeably attached to one of the pair of opposed spaced surfaces, the imprinting member is in the form of an eyebrow to be imaged on the skin of a user above the left eye and the transparent substrate includes a template for three positions into which the application element having an imprinting member can be repositioned to vary the characteristics of the imprinting member.
Figure 31:
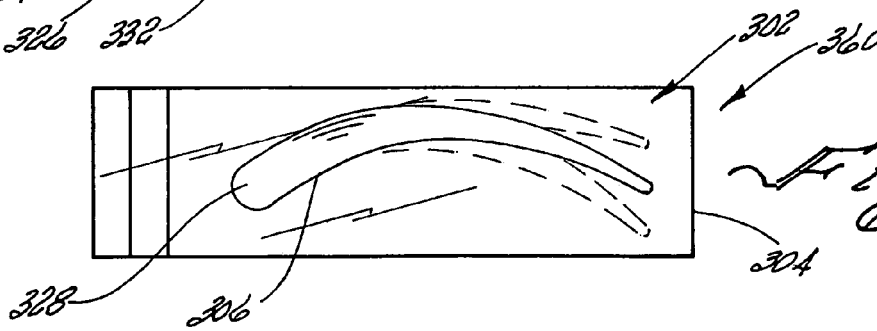
FIG. 31 is a rear elevational view of the imprinting device for a cosmetic product shown in FIG. 30.

FIGS. 30 and 31 show a front view and rear view of the imprinting device for a cosmetic product 360, respectively, comprising a transparent substrate 304, as shown in FIG. 29 having a pair of opposed spaced surfaces, the rear surface being shown as 302 in FIG. 31 has the application element 306 defining an imprinting member 328. The front surface is shown in FIG. 30.

The attachment element 306 is removeably attached the surface 304 as shown in FIG. 31 and the imprinting member 328 is in the form of an eyebrow to be imaged on the skin of a user above the left eye. The transparent substrate 302 includes the template for three positions 322, 324 and 326 into which the application element having an imprinting surface or imprinting member can be repositioned. In FIGS. 30 and 31, the application member 306 is illustrated to be in intermediate position 324. By repositioning the position of the application element 306, the shape of the eyebrow defined by the imprinting member 328 and can be varied to vary the characteristics of the imaged eyebrow.

FIG. 32 is a partial cross-sectional view of another embodiment of the imprinting device 360. The transparent substrate 304 has the attachment element 306 removeably attached thereto by means of an appropriate adhesive 366 which is compatible for use in cosmetic applications. Such adhesives are known to persons skilled in the art. Typical adhesives which can be used for this embodiment include Duo Glue Brand Adhesive, Latex based adhesives which are typically used for false eyelashes and fake eyelashes, duo embellishing glue or other adhesives which are compatible with the materials utilized for forming the transparent substrate and the application element.

The imprinting device of the present invention includes an attachment element having an exterior surface defining an imprinting element or imprinting member which is in the form of a predetermined image, e.g., an eyebrow, which is configured to be coated with a cosmetic product. During the imagining process using the method as described above, the cosmetic product coated predetermined image is transferred from the imprinting member in the form of the predetermined image to the epidermic layer of the skin and the cosmetic product is absorbed thereby to form a temporary imaged area of the skin.

The imprinting device of the present invention can be utilized with various cosmetic products. For purposes hereof, cosmetic products may include cosmetic inks, cosmetic pigments, creams, lotions, powders, paste, liquids, gels, and emulsions of wide ranging viscosity which are capable of forming an image on the epidermic layer of the skin.

Examples of cosmetic products which can be used in practicing the invention includes: (i) a Cosmetic liquid color offered for sale under the trademark USA BioTouch wherein the ingredients include water, organic pigment, Propylene Gylcol, Chamomile extract, Lavender extract, Sodium Benzoate, Aloe Vera, Citric acid; (ii) Lip-ink brand pigments comprising natural herbs and botanicals including golden seal, chamomile, rosemary extract, seaweed, calendula extract, beta carotene, Vitamins E, C, B-5 (panthenol), 13 trace minerals, UVA and UVB protection and natural humectants; and (iii) pigments sold under the trademark Dermagraphics including iron-oxide based pigments and pigments having the colors of black, light brown, brown, dark brown, chocolate brown, jet black (carbon), red wine, burgundy, red, dark red and taupe.

Pigments are also used in certain micro pigmentation procedures, a form of tattooing, which is used to apply "permanent makeup" for lip liner, eyeliner or eyebrow color.

For purposes hereof, the term "cosmetic products" is intended to cover all of the above-described inks, pigments and the like. Certain of the "cosmetic products" may not have sufficient viscosity to bridge the spacing between random patterns of dots or random patterns of predetermined areas and, and as a result, may come into contact with the transparent substrate. In such instances, it may be necessary to select a cosmetic product having the desired or required viscosity for practicing the invention as described herein. In the alternative, the chemistry formulation of the cosmetic product may be adjusted to the desired or required viscosity.

It is envisioned that the imprinting device can be used for applications other than in the cosmetology filed. For example, the imprinting device of the present invention could be used in surgical applications wherein the application element has an imprinting member which is configured into a predetermined image which is imprinted onto the skin a user as a template for the healthcare person or surgeon to follow or as a guide during a surgical procedure. Since the substrate is transparent, the user can perform the steps of visually confirming, by visually observing through the substrate, and rolling the cosmetic coated imprinting member over the desired location on the surface to imprint thereon the image defined by the imprinting member to insure that the imprinting element is positioned onto the selected or desired location on the skin of the user.

Another envisioned use of the imprinting device of the present invention is with dolls. A user can have a doll having a printable surface representing the skin of a person and the user can utilize the imprinting device to imprint images of eyebrows, noses, lips and the like on the printable surface of the doll.

This invention may be used in substantially the configuration of the preferred embodiment or of the disclosed alternate embodiments or variations thereof. It will be appreciated that various alterations and modifications may be made to imprinting device to enhance the functional characteristics thereof. All such variations and modifications should be considered to fall within the scope of the invention as broadly hereinbefore described and as claimed hereafter.

All such uses, variations, modifications and the like are anticipated to be within the scope of this invention.

What is claimed is:

1. An imprinting device for a cosmetic product comprising a rigid transparent substrate having a pair of opposed spaced surfaces; and an application element located on and protruding outwardly from one of the pair of opposed spaced surfaces, said application element having an exterior surface defining an imprinting member configured to have a cosmetic product coated thereon, said application element having a sufficient height between said one of the pair of opposed spaced surfaces and said imprinting member to inhibit a cosmetic product from contacting said one of the pair of opposed spaced surfaces when a cosmetic product is coated onto said imprinting member, said height being in the order of about 1/16 inch to about 1/2 inch and wherein the application element is removeably attached to said one of the pair of opposed spaced surfaces and wherein the substrate has a template showing various positions for the removeably attached application element and wherein a portion of the removeably attached application element can be repositioned on said one of the pair of opposed spaced surfaces to a position shown by the template to vary the imaging characteristics of the imprinting member.

2. The imprinting device of claim 1 wherein the imprinting member has a predetermined image formed thereon.

3. The imprinting device of claim 1 wherein the imprinting member has a predetermined curvilinear image formed thereon.

4. The imprinting device of claim 1 wherein the imprinting member has a predetermined image formed thereon in the shape of an eyebrow.

5. The imprinting device of claim 1 wherein the imprinting member has a predetermined image comprising a random pattern of dots formed thereon defining an eyebrow.

6. The imprinting device of claim 5 wherein the spacing between edges of the dots defining said random pattern of dots is of a dimension to enable a coated cosmetic product to bridge the spacing between dots.

7. The imprinting device of claim 1 wherein the imprinting member has a predetermined image comprising a random pattern of predetermined shaped areas formed thereon defining an eyebrow.

8. The imprinting device of claim 7 wherein the spacing between edges of the areas defining said random pattern of predetermined shaped areas is of a dimension to enable a coated cosmetic product to bridge the spacing between said predetermined shaped areas.

9. The imprinting device of claim 1 wherein the imprinting member has a predetermined image formed thereon in the shape of a flat eyebrow.

10. The imprinting device of claim 1 wherein the imprinting member has a predetermined image formed thereon in the shape of a curvilinear eyebrow.

11. The imprinting device of claim 1 wherein the imprinting member has a predetermined image formed thereon in the shape of an eyebrow having a plurality of spaced vertically extending ridge members defining individual eyebrow hairs.

12. The imprinting device of claim 1 wherein the imprinting member has a predetermined image formed thereon in the shape of an eyebrow having a plurality of spaced vertically extending ridge members defining individual eyebrow hairs originating from a common base line near an eye and terminating in random ends away from the eye.

13. The imprinting device of claim 1 wherein the imprinting member has a predetermined image formed thereon in the shape of an eyebrow and the portion of the removeably attached application element that can be repositioned on said one of the pair of opposed spaced surfaces varies the shape of the eyebrow.

14. The imprinting device of claim 1 wherein the imprintinq member has a predetermined image formed thereon in the shape of a moustache.

15. The imprinting device of claim 1 wherein the imprinting member has a predetermined image formed thereon in the shape of a sideburn.

16. The imprinting device of claim 1 wherein the imprinting member has a predetermined image formed thereon in the shape of a lip.

17. The imprinting device of claim 1 wherein the imprinting member has a predetermined image formed thereon in the shape of an areola.

18. The imprinting device of claim 1 wherein the imprinting member has a predetermined image formed thereon in the shape of a right eyebrow.

19. The imprinting device of claim 1 wherein the imprinting member has a predetermined image formed thereon in the shape of a left eyebrow.

20. The device of claim 1 wherein said substrate is substantially transparent and is generally rectangular in shape defining a pair of spaced elongated sides having a first shorter end and an opposed second shorter end extending there between and wherein said imprinting member is spaced between said pair of elongated sides and located a predetermined distance from said first shorter end.

21. The device of claim 20 wherein said first shorter end has at least one guideline formed thereon which extends substantially perpendicular between said pair of spaced elongated sides and substantially parallel to said first shorter side and said second shorter side, said at least one guideline being positioned at a predetermined location between said first shorter end and said imprinting member.

22. The device of claim 20 wherein said first shorter end has at least two spaced guidelines formed thereon which extend substantially perpendicular between said pair of spaced elongated sides and substantially parallel to said first shorter end and said second shorter end, said at least two guidelines being positioned at a predetermined location between said first shorter end and said imprinting member, said at least two guidelines being configured to enable a user to visually position one of the two guidelines in substantial alignment with a user's nose while concurrently observing through said transparent substrate that a cosmetic material coated imprinting member is correctly positioned over the eye thereby enabling a user to bring the imprinting member into contact with and to imprint an eyebrow on to a printing surface in the form of skin of the user.

23. A device for applying a cosmetic product comprising a rigid transparent substrate having a first surface, an opposed spaced substantially parallel second surface and an outer circumferential edge having a thickness defined by the spacing between said first surface and said second surface and a template defining positions for an application element; and an application element removeably attached to one of the first surface or second surface, said application element having an exterior surface positioned in an opposed spaced relationship from said one of the first surface or second surface and defining an imprinting member configured to have a cosmetic product coated thereon, said application element having a selected height between said imprinting member and said one of the first surface or second surface which is of a dimension to inhibit a cosmetic product from contacting said one of the first surface or second surface when a cosmetic product is being coated on the imprinting member and wherein a portion of the removeably attached application element can be repositioned on one of said first surface or second surface to a position shown by the template to vary the imaging characteristics of the imprinting member.

24. The device of claim 23 wherein the selected height of the application element is in the order of about 1/16 inch to about 1/2 inch.

25. The device of claim 23 wherein the substrate has a template in the form of an eyebrow showing positions for the removeably attached element and wherein a portion of the removeably attached application element is in the form of an eyebrow and can be repositioned on said one of the first surface or second surface to a position shown by the template to vary the eyebrow imaging characteristics of the imprinting member.

26. A method for imprinting a cosmetic product on to a surface comprising the steps of:

forming an imprinting device having a rigid transparent substrate having a pair of opposed spaced surfaces and an application element located on and protruding outwardly from one of the pair of opposed spaced surfaces and wherein said application element has an exterior surface defining an imprinting member having a selected image and configured to have a cosmetic product coated thereon and further wherein said application element has a sufficient height between said one of the pair of opposed spaced surfaces and said imprinting member to inhibit a cosmetic product from contacting said one of the pair of opposed spaced surfaces when a cosmetic product is coated onto said imprinting member and wherein said height is in the order of about 1/16 inch to about 1/2 inch and the application element is removeably attached to said one of the pair of opposed spaced surfaces and wherein a portion of the removeably attached application element can be repositioned to a position shown by a template on the substrate to vary the imaging characteristics of the imprinting member;

applying a cosmetic product onto said imprinting member;

visibly observing the cosmetic coated imprinting member through said transparent substrate and concurrently positioning the cosmetic coated imprinting member at a desired location on a surface to be imaged;

rolling said cosmetic coated imprinting member over the desired location on the surface to imprint thereon the image on said imprinting member; and withdrawing said imprinting member from the surface.

27. The method of claim 26 wherein the step of forming an imprinting device includes forming an image thereon in the shape of an eyebrow.

28. The method of claim 26 wherein the substrate has a template showing various positions for the removeably attached application element and further comprising the step of repositioning a portion of the removeably attached application element on said one of the pair of opposed spaced surfaces to a position shown by the template to vary the imaging characteristics of the imprinting member.

29. The method of claim 26 wherein the step of forming an imprinting device includes a substrate which is generally rectangular in shape defining a pair of spaced elongated sides and a first shorter end and an opposed second shorter end and wherein said imprinting member is spaced between said pair of elongated sides and located a predetermined distance from said first shorter end and further wherein said first shorter end has at least one spaced guideline formed thereon which extends substantially perpendicular between said pair of spaced elongated sides and substantially parallel to said first shorter end and said second shorter end, said at least one guideline being positioned at a predetermined location between said first shorter end and said imprinting member, said method further comprising the steps of placing at least one guideline in substantial alignment with a reference point while concurrently visually observing through said transparent substrate that a cosmetic material coated imprinting member is correctly positioned over the desired location of a surface thereby enabling the imprinting of an image on to the surface.

30. The method of claim 26 wherein the step of forming includes the imprinting member being in the shape of an eyebrow and the step of placing includes the reference point being a users nose, the step of placing further comprising:

placing at least one guideline in substantial alignment with a user's nose while concurrently visually observing through said transparent substrate that a cosmetic material coated imprinting member is correctly positioned over an eye of a user thereby enabling a user to imprint an eyebrow on to a surface in the form of the skin of the user.

* * * * *